United States Patent [19]

Welles

[11] Patent Number: 5,028,024

[45] Date of Patent: Jul. 2, 1991

[54] FOOTREST FOR TOILET

[76] Inventor: William F. Welles, 4295 Gesner St., San Diego, Calif. 92117

[21] Appl. No.: 471,560

[22] Filed: Jan. 29, 1990

[51] Int. Cl.[5] ..... F16M 13/00

[52] U.S. Cl. ..... 248/163.1; 4/254; 297/439

[58] Field of Search ..... 248/670, 163.1, 188.5; 4/254; 297/439

[56] References Cited

U.S. PATENT DOCUMENTS

| | | | |
|---|---|---|---|
| 1,072,526 | 9/1913 | Stiles | 248/670 X |
| 2,250,060 | 7/1941 | Finlay | 4/254 |
| 2,461,622 | 2/1949 | Alikas | 297/439 X |
| 2,834,028 | 5/1958 | Stanley | 4/254 |
| 2,903,714 | 9/1959 | Grondona | 4/254 |
| 3,383,714 | 5/1968 | Minasian et al. | 4/254 |
| 3,619,820 | 11/1971 | Cain et al. | 4/254 |
| 3,785,702 | 1/1974 | Buehring | 297/439 |
| 4,024,659 | 5/1977 | Ingerdahl | 248/188.5 X |
| 4,713,846 | 12/1987 | Hodroski, Jr. | 4/254 |

FOREIGN PATENT DOCUMENTS

| | | | |
|---|---|---|---|
| 308641 | 7/1939 | United Kingdom | 4/254 |

*Primary Examiner*—David L. Talbott
*Attorney, Agent, or Firm*—Charles C. Logan, II

[57] ABSTRACT

A footrest for a conventional toilet that may be conveniently stored in a nested position under the toilet bowl. The footrest has a left side frame and a right side frame that are connected at their forward ends by a telescoping connecting member. The side frame members each a vertically oriented U-shaped portion that is connected to a cantilever portion having foot platforms mounted thereon. The footrest is used to facilitate a toilet user assuming a semi-squatting position during use. The footrest may also be used by children or other person's whose legs do not reach the floor when on the toilet.

2 Claims, 1 Drawing Sheet

FOOTREST FOR TOILET

BACKGROUND OF THE INVENTION

The invention relates to a footrest and more particularly to devices that control the position of a person sitting on a toilet.

It is well known the toilet construction currently in use in the western world, including both the toilet bowls and the toilet seats, are not designed to take full advantage of the toilet user's physiological functions. Current toilet construction usually comprises a bowl attached to an inwardly sloping support and a seat of generally horizontal orientation. In brief, the shape of conventional toilets significantly interferes with blood circulation in the user's legs. Furthermore, the user's sitting position while on the toilet tends to compress the user's buttocks, thereby hampering the elimination process. It is significant that poor blood circulation and strain are among the leading causes of the painful condition of hemorrhoids.

Various studies regarding the toilet and elimination process have suggested that to maximize elimination efficacy and minimize strain on the toilet user, the user should assume a semi-squat position on the toilet. In this position, the user's thigh muscles, resting against the upper groin area, can result in the elimination of a larger percentage of excrement from the body.

In addition, the conventional toilet is made of a size to suit the average adult person. Thus, the conventional toilet is difficult to use by small children or other persons with very short legs. The short legs tend not to reach the ground and dangle unsupported. The person may experience discomfort or insecurity due his dangling legs while using the toilet.

The prior art comprises sculpted toilet seats and foot rests for the toilet user. The sculpted toilet seats, which replace conventional seats, have elevated and depressed portions arranged so that (1) the user's buttocks are left uncompressed or (2) the user is urged to lean forward during the elimination process. In either case, the user relieves some of the strain otherwise encountered during the elimination process. Alternatively, the footrests are either permanently attached to the toilet bowl support or temporarily hooked over the upper lip of the toilet bowl, usually between the existing seat and the bowl.

The prior art devices have three major drawbacks. First, devices that are permanently attached to the toilet do not allow a toilet to be used in the conventional manner. Second, the detachable devices need a place for storage and often require more time to set up than is available when a person needs to use the toilet. Third, the devices in general are decoratively unattractive or intimidating to the user.

It is an object of the invention to provide a novel footrest that is easily and quickly stored under the bowl of the toilet.

It is also an object of the invention to provide a novel footrest for a toilet that is not attached to the toilet bowl or tank.

It is another object of the invention to provide a novel footrest for a toilet that is economical to manufacture and market.

It is a further object of the invention to provide a novel footrest for a toilet that can be used by children and adults.

SUMMARY OF THE INVENTION

The novel footrest for a toilet is formed from a left side frame and a right side frame. Both of these frames are preferably made from square tubular steel. Each frame member has a connecting leg portion at its forward end that extends transversely to its longitudinally extending intermediate portion. A square shaped wood connecting member telescopes into the respective open ends of the leg portions so that the width of separation between the two frame members may be adjusted. Each of the frame members has a vertically oriented U-shaped portion that extends upwardly from the rear end of the intermediate portion. A cantilevered portion extends forwardly from the top end of the U-shaped portion at a predetermined spaced height above the intermediate portion. A foot platform is secured to the top surface of each of the cantilever portions.

The footrest is storable in a nested position with the front frame member and side frame members slid back into contact with the base support of the toilet bowl. The lateral spacing of the frame members may be adjusted by telescopically pulling the connecting leg portions apart. When the footrest is being used, the user has his knees in a raised position with his femurs canted upwardly, resulting in the body properly aligning the intestional tract and allows the use of gravity and abdominal tension, while relieving strain on the sphincter muscles.

DESCRIPTION OF THE PREFERRED EMBODIMENT

Figure 1:
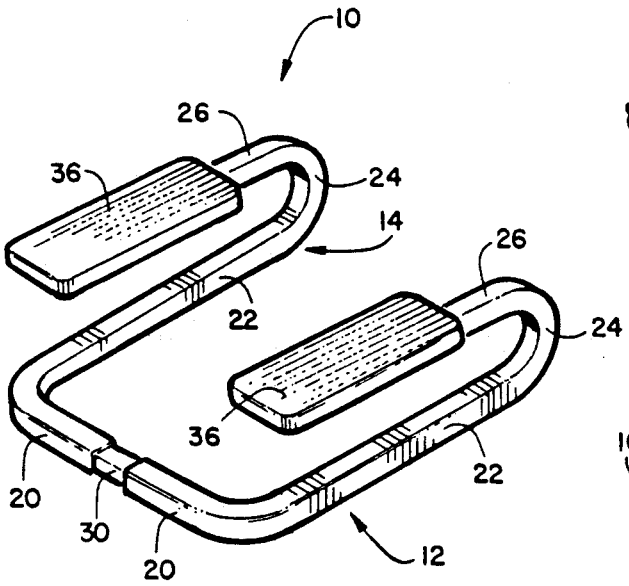
FIG. 1 is a front perspective view of applicant's novel footrest for a toilet.
Figure 2:
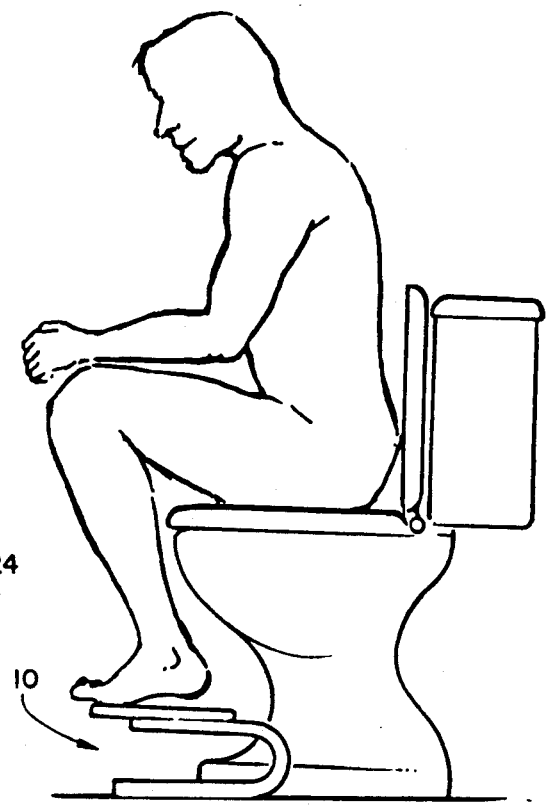
FIG. 2 is a side elevation view illustrating a person using the footrest.

Applicant's novel footrest will now be described by referring to FIGS. 1–5 of the drawing. The footrest is generally designated numeral 10.

Footrest 10 has a left side frame member 12 and a right side frame member 14. Each of these side frame members have a connecting leg portion 20, an intermediate portion 22, a vertically oriented U-shaped portion 24, and a cantilever portion 26.

Figure 3:
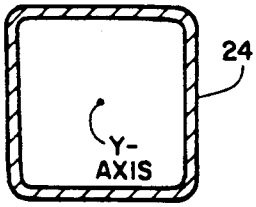
FIG. 3 is a cross sectional view taken along lines 3—3 of FIG. 5.
Figure 4:
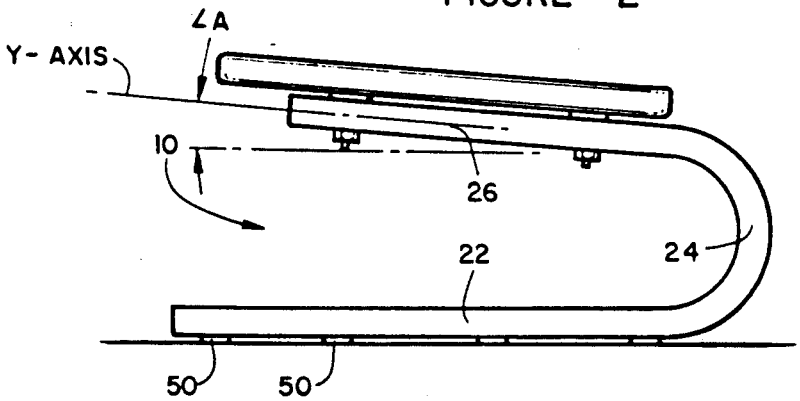
FIG. 4 is a side elevation view of the footrest.
Figure 5:
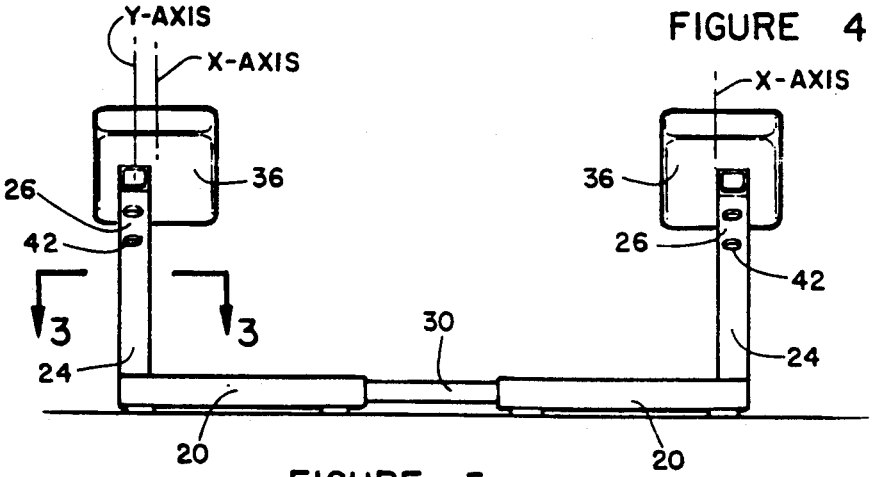
FIG. 5 is a front elevation of the footrest.

The frame members are preferably made of square tubular steel. The open end of the connecting leg portions 20 receive a solid wooden square shaped connecting member 30 that has its opposite ends telescoped into the respective connecting leg portions. The cross section of the tubular steel frame is illustrated in FIG. 3.

Foot platforms 36 are mounted on the top surface of the cantilever portions 26. The structure used for accomplishing this are gripping plates 38 that capture one end of a threaded stud 40. The threaded stud passes downwardly through aligned apertures and the cantilever portion and is fastened tightly thereto by nuts 42. The foot platforms have a longitudinally extending x-axis that is laterally offset inwardly from the longitudinal Y-axis of the cantilever portions 26. Cantilever portion 26 has its front end upwardly inclined at an acute angle A to the horizontal.

The plurality of friction gripping pads 50 are secured to the bottom surface of the left and right side frame members.

What is claimed is:

1. A footrest for a toilet comprising:

a left side frame having a horizontally elongated intermediate portion having a front end and a rear end, a transversely extending connecting leg portion connected to said front end, a vertically oriented U-shaped portion connected to said rear end, an elongated cantilever portion having a longitudinally extending Y-axis and it is connected to said U-shaped portion so that said cantilever portion extends out over said intermediate portion, an elongated foot platform having a longitudinally extending X-axis and means for mounting it on said cantilever portion so that said X-axis is spaced laterally inwardly a predetermined distance from the Y-axis of said cantilevered portion;

a right side frame having a horizontally oriented elongated intermediate portion having a front end and a rear end, a transversely extending leg portion connected to said front end, a vertically oriented U-shaped portion connected to said rear end, an elongated cantilever portion having a longitudinally extending Y-axis and it is connected to said U-shaped portion so that said cantilever portion extends out over said intermediate portion, an elongated foot platform having a longitudinally extending X-axis and means for mounting it on said cantilever portion so that said X-axis is spaced laterally inwardly a predetermined distance from the Y-axis of said cantilever portion;

said left and right side frames being made of square tubular steel;

said foot platforms being oriented so that they are inclined upwardly from rear to front at an acute angle; and means for connecting said transversely extending connecting leg portions together comprising an elongated connecting member that has a square cross section and its opposite ends telescope into said respective connecting leg portions so that the width of said footrest can be adjusted.

2. A footrest as recited in claim 1 wherein said elongated connecting member is made out of wood material.

* * * * *